United States Patent [19]

Halliday

[11] Patent Number: 4,539,768

[45] Date of Patent: Sep. 10, 1985

[54] DIGITAL DISPLAY APPARATUS

[76] Inventor: John J. Halliday, 8 McAdam Dr., Enfield, Middlesex, England

[21] Appl. No.: 621,178

[22] Filed: Jun. 15, 1984

[51] Int. Cl.[3] ..... G09F 3/04

[52] U.S. Cl. ..... 40/447; 40/450; 40/492

[58] Field of Search ..... 40/447, 450, 451, 452, 40/446, 492, 5; D28/60

[56] References Cited

U.S. PATENT DOCUMENTS

| | | | |
|---|---|---|---|
| D. 192,590 | 4/1962 | Leopoldi | D28/60 |
| 567,379 | 9/1896 | Dalumi | 40/447 |
| 1,357,457 | 11/1920 | Jorgensen | 40/450 |
| 4,063,377 | 12/1977 | Hukill | 40/492 |

FOREIGN PATENT DOCUMENTS

| | | | |
|---|---|---|---|
| 25082 | 9/1919 | Denmark | 40/447 |
| 27318 | 3/1921 | Denmark | 40/447 |
| 0012803 | 7/1980 | European Pat. Off. | 447/ |
| 0041074 | 12/1981 | European Pat. Off. | 40/447 |
| 1137299 | 12/1968 | United Kingdom | 40/447 |
| 2045991A | 11/1980 | United Kingdom | 40/447 |
| 1595532 | 8/1981 | United Kingdom | 40/447 |
| 2015799B | 10/1982 | United Kingdom | 40/447 |

*Primary Examiner*—Gene Mancene
*Assistant Examiner*—James Hakomaki
*Attorney, Agent, or Firm*—Harness, Dickey & Pierce

[57] ABSTRACT

The digital display apparatus comprises a board having one or more seven-element digital-type displays marked thereon. A flap is provided for each of the elements and is pivotable from a first position in which the associated element is exposed, to a second position in which it covers its associated element. Selective pivoting of the flaps enables each display to form any required digit.

8 Claims, 7 Drawing Figures

DIGITAL DISPLAY APPARATUS

BACKGROUND AND SUMMARY OF THE INVENTION

The present invention relates generally to a digital display apparatus and more particularly to a unique apparatus which allows the change of numerical digits manually and in a quicker and less costly manner than previously known.

As is well known, the selling of certain commodities and goods, such as gasoline and cigarettes, necessitates frequent changing of the signs displaying the price to the public. At the present time, this is most frequently effected by the changing of plates bearing numerals or the numerals themselves, which is time consuming and requires the storage and handling of a large number of plates. Alternatively, in some cases, electronic digital displays are used, but these are extremely costly.

One object of the present invention is to provide a digital display apparatus which is of simple mechanical construction. Another object of the invention is to overcome the disadvantages referred to above with known gasoline, cigarette and other commodity price signs. A still further object of the invention is to provide a price sign which is less expensive than price signs presently being used, has fewer removable parts and pieces, is reliable and efficient, is easy to operate, and is capable of being used by persons of all skills and education.

The present inventive digital display apparatus comprises a board or backing member having one or more seven-element object displays (e.g., numerals) marked thereon and a flap or shield for each element of each of the object displays. Each of the flaps is pivotable from a first position in which the associated element is uncovered and exposed, and to a second position in which the associated element is covered. With this arrangement, selective pivoting movement of the individual flaps enables the elements to form and display any required digit (from 0 to 9).

Additional benefits and advantages of the present invention will become apparent from the subsequent description of the preferred embodiments and the appended claims, taken in conjunction with the accompanying drawings.

BRIEF DESCRIPTION OF THE DRAWINGS

FIGS. 6 and 7 depict another embodiment of a flap hinging arrangement.

DESCRIPTIONS OF THE PREFERRED EMBODIMENTS

Figure 1:
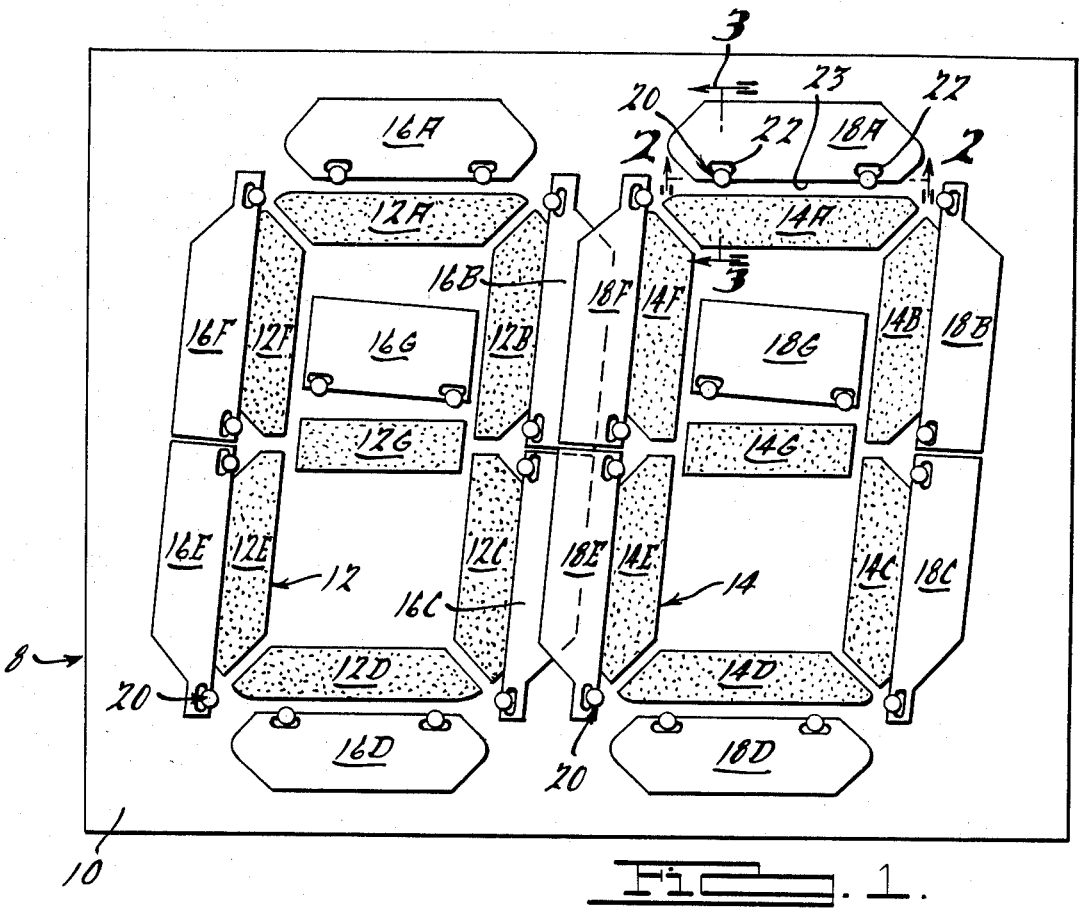
FIG. 1 is a front elevational view of a digital display apparatus according to the present invention.

In accordance with one embodiment of the invention, the digital display apparatus (which is referred to generally by the numeral 8) comprises a display board 10 of rectangular configuration having two seven-segment displays 12 and 14 indicated thereon. The displays 12 and 14 each simulate the basic pattern of a digital-type display and are painted, printed, glued or otherwise affixed on or to the display board 10. As shown in FIG. 1, the display 12 comprises seven elements 12A to 12G and the display 14 comprises seven elements 14A to 14G.

In the embodiment shown in FIG. 1, the board 10 is transparent or colored white with each seven-segment display 12 and 14 colored black or a darker color. It will be readily appreciated, however, that a reverse arrangement can be utilized. For example, the board 10 can be black or any dark color and the respective seven-segment displays 12 and 14 can be lighter in color or translucent so that they may, if desired, be illuminated from the rear.

Each element 12A to 12G has, respectively, an associated flap or shield 16A to 16G and each element 14A to 14G has, respectively an associated flap or shield 18A to 18G. The flaps 16A to 16G and 18A to 18G are the same color as the board 10 in order to blend in with the board and be unnoticeable from a distance. The board 10 can be made of any sturdy and durable material, such as metal, plastic or wood, and preferably is made of aluminum. Similarly, the flaps or shields can be made of any sturdy and durable material, and preferably are made of a rigid plastic material.

Figure 4:
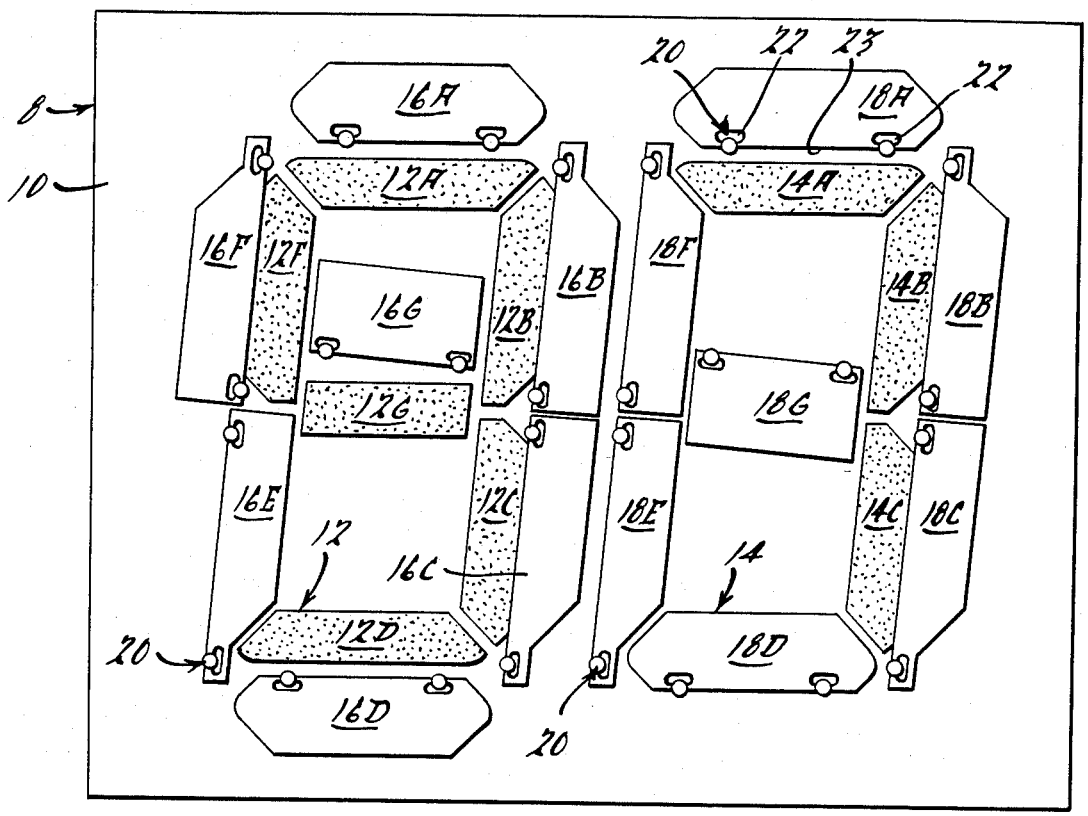
FIG. 4 is a front elevation of the apparatus, similar to FIG. 1, but showing a selected number.
Figure 5:
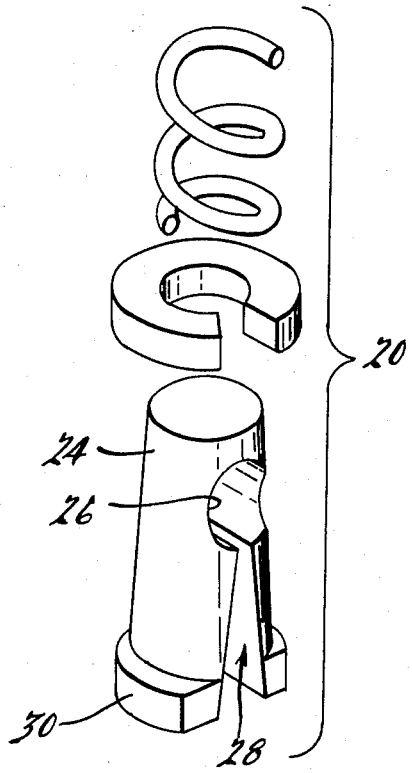

Each flap is shaped and mounted on spaced pivots 20 so that it can be pivoted from the position shown in FIG. 1 where all the elements 12A to 12G and 14A to 14G of the displays are exposed, to a position in which one or more associated elements are covered (as hereinafter described) so that a desired numeral or letter is displayed, as shown in FIG. 4. When the flaps are in their exposed or covered positions, they rest against the board 10 and are positioned parallel to it.

Figure 2:
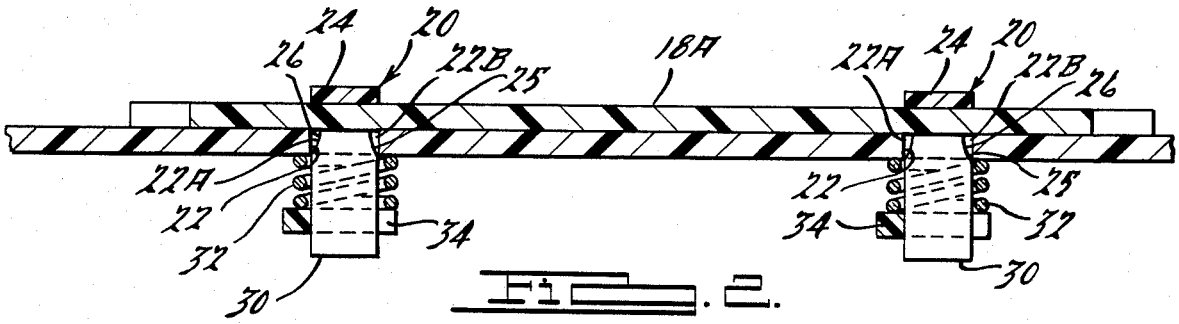
FIG. 2 is a cross-sectional view taken along the line 2—2 of FIG. 1.
Figure 3:
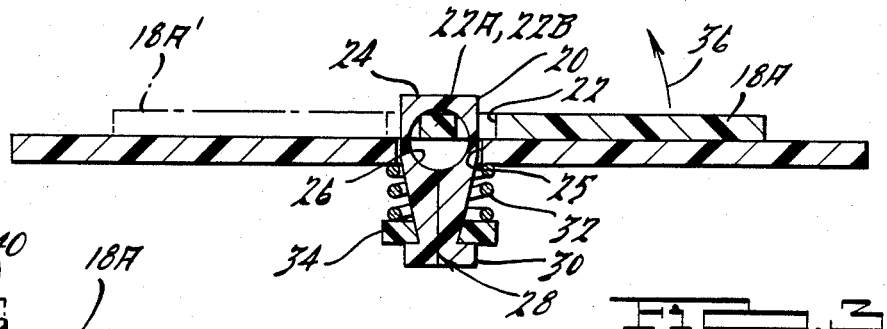
FIG. 3 is a cross-sectional view taken along the line 3—3 of FIG. 1.
Figure 5:
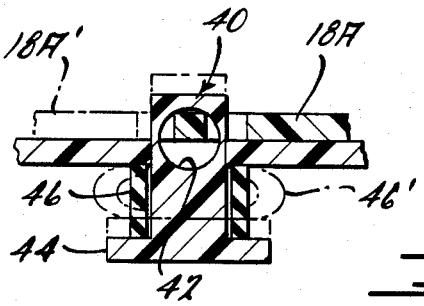
FIG. 5 is a detailed exploded view of the flap hinging arrangement.

The pivoting arrangement for each flap 16A to 16G and 18A to 18G in accordance with one embodiment is shown in FIGS. 2, 3, and 5. A pair of slots 22 is provided in each flap along one side 23 thereof and adjacent its ends. On the board 10, the sides 23 of the flaps are situated immediately adjacent associated elements of the digital-type numerals. Each of the pivots 20 comprises a stud member 24 which is preferably made of a plastic material. The stud member 24 has a transversely extending hole or aperture 26 near one end, a longitudinal slot 28 which extends from the aperture 26 to the opposite end of the stud, and an outwardly extending flange 30 on the end opposite the aperture.

A pair of pivot members 22A and 22B are provided adjacent the openings of each of the slots 22. The pivot members are adapted to be positioned in opposite ends of the openings (apertures) 26 in the studs 24. A pair of openings 25 is provided in the board 10 adjacent one of the edges of each of the seven segments of each of the displays 12 and 14. The openings 25 are dimensioned to allow the stud members 24 to be loosely positioned therein.

In assembly, a stud 24 is first mounted in each slot 22 with the pivot members 22A and 22B being positioned in the opening 26. The stud 24 is then passed through an aperture 25 in the board 10 and retained on the other side thereof by a resilient member (coil spring) 32 and cotter clip 34 which engages the stud flange 30.

The flaps are thus moveably spring-mounted so they can be flipped from one position to the other either covering or uncovering one of the segments forming the digital-type displays. As shown in FIG. 3, when a flap, for example 18A, is pivoted in a direction indicated by the arrow 36, it passes through a vertical position relative to the board 10, which causes the stud flange 30 to be moved towards the rear side of the board 10 and the spring 32 to be compressed. The pivot members 22A and 22B are shaped to act as "cam" members in this regard. As the flap 18A pivots downwardly towards a position covering its associated element (as 18A is shown in phantom lines in FIG. 3), the spring 32 reasserts itself and urges the flap 18A into a position parallel with the board 10. In addition, the force applied on the flaps or shields by the spring-mounted stud member 24 acts to hold the flaps in position against the board. This creates a more aesthetic display and prevents the wind and other weather forces from raising and/or flipping the flaps over.

Thus, it can be seen that selective pivoting of the flaps 16A to 16G, or 18A to 18G, enables the elements 12A to 12G or 14A to 14G to form and display any desired numeral. For example, as shown in FIG. 4, pivoting of the flaps 16E and 18D to 18G so that they cover their associated elements 12E and 14D to 14G causes the number "97" to be displayed.

It will be appreciated that the display board 10 may comprise any required number of seven-segment displays. It is also possible to provide one or more flaps on the board which are adapted to cover complete digits or even entire words and phrases. For example, on a sign used for gasoline stations, a flap could be provided which could be alternately flip-flopped to cover or expose either "Leaded" or "Unleaded", or "Diesel" or "Premium". Similarly, for cigarette price signs, a flap could be provided which would indicate that the price noted was "Per Carton" or "Per Pack". Flaps also could be provided to cover or expose dollar signs ("$"), cents signs ("¢"), "9/10" signs ("0.9"), or the numeral one ("1") used as the tens digits.

Figure 7:
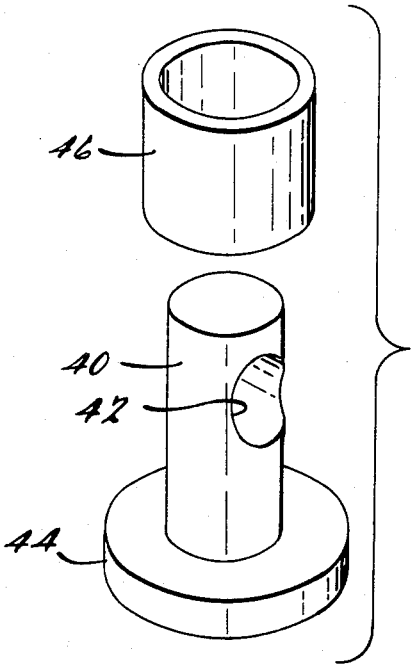

An alternate embodiment of the invention is shown in FIGS. 6 and 7. This embodiment utilizes a different type of spring or resilient mechanism 46 for loading the flaps and holding them in place. The stud 40 is cylindrical in cross section with an opening 42 near one end and a collar or flange 44 on the other end. The resilient member 46 has a hollow cylindrical or tube-shape and is made of a resilient material, such as an elastomeric material, rubber, or silicone. The resilient tube 46 is positioned between the flange 44 and the rear surface of the board 10 and functions in the same manner and for the same purpose as the coil spring 32 described above. Also, the flaps 16A to 16G and 18A to 18G are mounted on each of the studs 40 in the same manner as described above and operate in the same manner.

The foregoing descriptions represent merely exemplary embodiments of the present invention. Various changes may be made in the arrangements and details of production of the embodiments shown without departing from the spirit and scope of the present invention.

I claim:

1. A digital display apparatus comprising a board having one or more seven-element displays marked thereon, a flap for selectively covering and uncovering each element of the display, and pivot means connecting said flaps to said board, said flaps being manually pivotal from a first position in which the associated element is exposed, to a second position in which it covers the associated element, said pivot means comprising spaced apertured stud members positioned in a slot adjacent the edge of the flap and spring means, said stud members being mounted in spaced apertures in said board with each flap and said spring means resiliently retaining each of said flaps in said first or second position, whereby selective pivoting movement of the individual flaps enables the elements to form and display any required digit from 0 to 9.

2. A digital display apparatus as set forth in claim 1, wherein said resilient means comprises an axially resilient means encircling said stud.

3. A digital display apparatus as set forth in claim 1, wherein said resilient means comprises a resilient tubular-shaped member.

4. A digital display apparatus as set forth in claim 1, wherein said board is dark colored and each of said seven-element displays is light colored.

5. A digital display apparatus as set forth in claim 4, wherein said seven-element displays are translucent and electric lamps are provided adjacent the rear surface of said board.

6. A digital display apparatus as set forth in claim 1 wherein said spring means comprises a coil spring encircling the outer surface of said stud.

7. A digital display apparatus as set forth in claim 1, wherein said spring means comprises a resilient tubular-shaped member made of a plastic material.

8. A digital display apparatus as set forth in claim 1, wherein said flaps have cam means thereon which are mounted in an aperture in said stud members.

* * * * *